United States Patent [19]

Tada

[11] Patent Number: 4,468,646

[45] Date of Patent: Aug. 28, 1984

[54] SUPERCONDUCTING MAGNET DEVICE

[75] Inventor: Naofumi Tada, Hitachi, Japan

[73] Assignee: Hitachi, Ltd., Tokyo, Japan

[21] Appl. No.: 382,103

[22] Filed: May 26, 1982

[30] Foreign Application Priority Data

Jun. 5, 1981 [JP] Japan ..... 56-85750

[51] Int. Cl.[3] ..... H01F 7/22

[52] U.S. Cl. ..... 335/216; 335/299

[58] Field of Search ..... 335/216, 299; 174/126 S, 128 S

[56] References Cited

U.S. PATENT DOCUMENTS 4,195,199 3/1980 Hillmann et al. ..... 335/216 X
4,218,668 8/1980 Tada et al. ..... 335/216
4,234,861 11/1980 Woolcock et al. ..... 335/216

*Primary Examiner*—George Harris
*Attorney, Agent, or Firm*—Antonelli, Terry & Wands

[57] ABSTRACT

Herein disclosed is a superconducting magnet device which is produced by winding both intermetallic compound superconducting wires and cold-worked oxygen-free copper wires in parallel and in multiple layers upon the core of a coil.

10 Claims, 5 Drawing Figures

SUPERCONDUCTING MAGNET DEVICE

BACKGROUND OF THE INVENTION

1. Field of the Invention

The present invention relates to a superconducting magnet device using an intermetallic compound superconducting coil and, more particularly, to an intermetallic compound superconducting coil suitable for use with a superconducting magnet device for high magnetic fields of the so-called "medium or large size", which reserves energy exceeding one megajoule as a result of application of a high electromagnetic force.

2. Description of the Prior Art

In recent years, as an intermetallic compound superconducting coil for generating a high magnetic field of 13 to 15 teslas, there has been used an intermetallic compound superconducting coil which is made of $Nb_3Sn$ and $V_3Ga$.

This superconducting magnet device using the superconducting coil made of an intermetallic compound such as $Nb_3Sn$ or $V_3Ga$ is disclosed, for example, in FIGS. 1 and 2 of Japanese Patent Laid-Open No. 54-120882, entitled "Superconductor".

Specifically, the superconductor as disclosed in FIG. 2 of the Japanese Patent Laid-Open No. 54-120882 is produced by forming superconducting wires of an intermetallic compound such as $V_3Ga$ and a Cu—Ga alloy into an intermetallic compound complex superconductor region and by burying the complex superconductor region in a groove of a copper stabilizer so as to thermally stabilize a resultant superconducting coil. The superconductor thus produced has a defect that it is deformed, if a strong electromagnetic force (which is equal to or stronger than 10 $Kg/cm^2$ for the coil of a medium or larger size) is applied thereto, to have its characteristics deteriorated.

Moreover, the superconductor requires a large quantity of copper stabilizer for retaining the stability of the large-sized coil. In order to retain a strength sufficient to endure the electromagnetic force, still moreover, the sectional area of the stabilizer itself has to be enlarged. As a result, the superconducting coil using such intermetallic compound superconductor has its overall current density reduced for the whole coil so that it cannot be applied to a superconducting magnet device of medium or larger size for a high magnetic field requiring a high current density.

On the other hand, the superconductor as disclosed in FIG. 2 of the Japanese Patent Laid-Open No. 54-120882 is produced by arranging a reinforcement member of stainless steel or the like at the center of a region of an intermetallic compound complex superconductor. The superconductor thus prepared is sufficient for the strength and the thermal stability but it finds it remarkably difficult to produce a long conductor because it is made of such a complex material as has difficult workability.

SUMMARY OF THE INVENTION

It is, therefore, an object of the present invention to provide a superconducting coil which is suitable for use with a superconducting magnet device for generating a high electromagnetic stress and which is strong and thermally stable.

Another object of the present invention is to provide a superconducting coil which is strong and thermally stable and which can reduce as much as possible such a strain to be applied to an intermetallic compound superconductor as is caused when in the winding operation of the superconducting coil.

In order to achieve the above-identified first object, according to the present invention, a superconducting magnet device is produced by winding hardened oxygen-free copper wires upon the core of a superconducting coil in parallel and in multiple layers together with intermetallic compound superconducting wires.

In order to achieve the above-identified second object, according to the present invention, a superconducting magnet device is produced by winding hardened oxygen-free copper wires together with intermetallic compound superconducting wires upon the core a superconducting coil in parallel and in multiple layers without being metallically bonded to each other.

In order to achieve the above-identified first object of the present invention, the hardened oxygen-free copper wires are used so that their strength can be enhanced by the hardening treatment, as will become apparent from the following description. According to the present invention, moreover, the specific resistance of the oxygen-free copper can be reduced to a low value at a liquid helium temperature of 4.2° K., at which the superconducting coil is used, in spite of the use of the hardened oxygen-free copper so that the heat liberation of the oxygen-free copper in service can be reduced. Thus, according to the present invention, the thermal stability of the superconducting magnet device as a whole can be improved. According to the present invention, still moreover, the specific resistance of the oxygen-free copper to be wound together with the intermetallic compound superconducting wires can be reduced, as has been described hereinbefore, so that the density of the current to flow through the intermetallic compound superconducting coil can be increased. As a result, it is possible to provide a superconducting magnet device which is suitable for a superconducting coil to generate a high electromagnetic stress.

In order to achieve the above-identified second object of the present invention, furthermore, the oxygen-free copper wires and the intermetallic compound superconducting wires are wound upon the core of the superconducting coil without being metallically bonded to each other. As a result, a strain during the winding operation is not established at the superconducting wires so that the high electromagnetic stress can be sustained by the oxygen-free copper wires and so that the strain to be generated in the intermetallic compound superconducting coil can be reduced. According to the present invention, therefore, it is possible to easily produce an intermetallic compound superconducting coil of medium or larger size for generating a high magnetic field.

DESCRIPTION OF THE PREFERRED EMBODIMENTS

Figure 1:
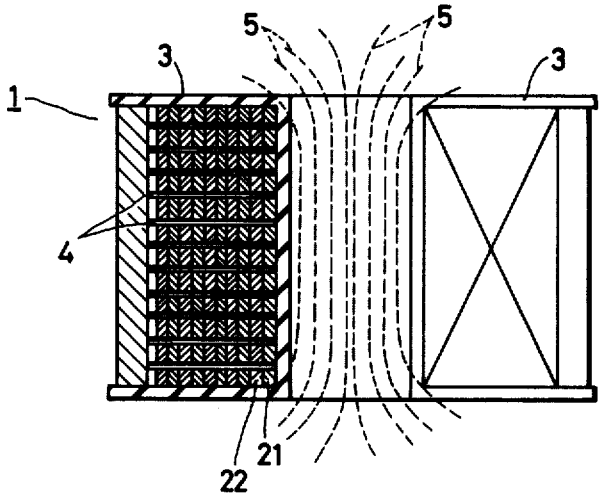
FIG. 1 is a sectional view showing a superconducting coil according to one embodiment of the present invention.

With reference to FIG. 1, a superconductive coil 1 is constructed of superconducting wires 21, which have a rectangular cross-section, and oxygen-free copper wires 22, which have been hardened, both being wound on a coil bobbin 3. The superconducting wires 21 and the oxygen-free copper wires 22 are wound upon the core of the superconducting coil 1 in parallel and in multiple layers such that they are not metallically bonded but merely overlaid, as is different from a chemical compound. Reference numeral 4 indicates cooling channels for allowing liquid helium to pass therethrough. Broken lines 5 indicate the flows of magnetic flux. A not-shown insulator is disposed at the boundary between the adjacent superconducting wires.

The intermetallic compound superconducting coil according to the present invention will be described in detail with reference to FIGS. 2 and 3.

The present invention has been conceived by the following discoveries as a result that the intermetallic compound superconducting coil has been systematically investigated.

Figure 2:
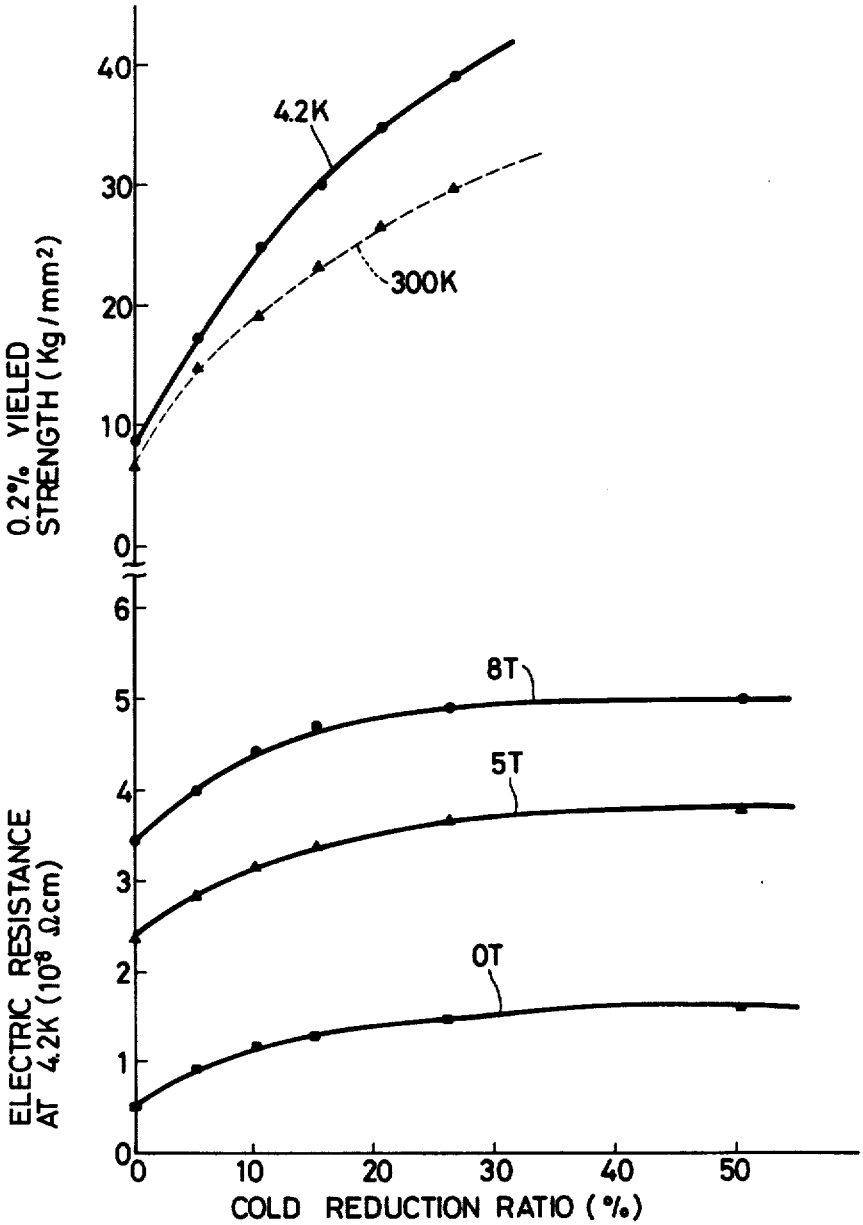
FIG. 2 is characteristic diagrams showing the relationships of a specific resistance and a 0.2% yield strength to the cold reduction ratio of a stabilizing material to be used in the superconducting coil of the present invention.

When the intermetallic compound superconducting wires made of $Nb_3Sn$ or $V_3Ga$ for generating a high magnetic field are to be applied to a superconducting coil of medium size, a stabilizing material is required to have a thermal stability and a sufficient reinforcing function. From these points of view, the cold-worked oxygen-free copper is used to conduct experiments as to both the specific resistance of the oxygen-free copper for the cold reduction ratio at a temperature of 4.2° K. when in the actual use, at which the intermetallic compound superconducting coil is cooled by liquid helium, and the stress, i.e., the 0.2% yield strength for the elastic deformation of 0.2%, which is considered as one of the measures for the strength of the material. On the basis of the experimental results, the following discoveries are made:

First of all, if the oxygen-free copper was cold-worked, as shown in FIG. 2, the experimental results were that the specific resistance (Ωcm) at 4.2° K., which determines the thermal stability, was saturated under the respective magnetic fields at 0 tesla, 5 teslas and 8 teslas as the cold reduction proceeded, i.e., as the cold reduction ratio was increased, and that the 0.2% yield strength was increased with the increase in the cold reduction ratio. The oxygen-free copper wires are used in the liquid helium at 4.2° K. after they have been wound together with the intermetallic compound superconducting wires. Under such condition, however, the specific resistance of the oxygen-free copper is saturated with the increase in the cold reduction ratio so that it is not increased any more.

On the other hand, the 0.2% yield strength is increased with the proceeding of the hardening process, as shown in FIG. 2, and is higher at a low temperature of 4.2° K. than at a high temperature of 300° K. Therefore, the oxygen-free copper wires having been cold-worked are a suitable material for strength.

Thus, the cold-worked oxygen-free copper wires can be used as single metal for a reinforcing material and for a stabilizing material.

Figure 3:
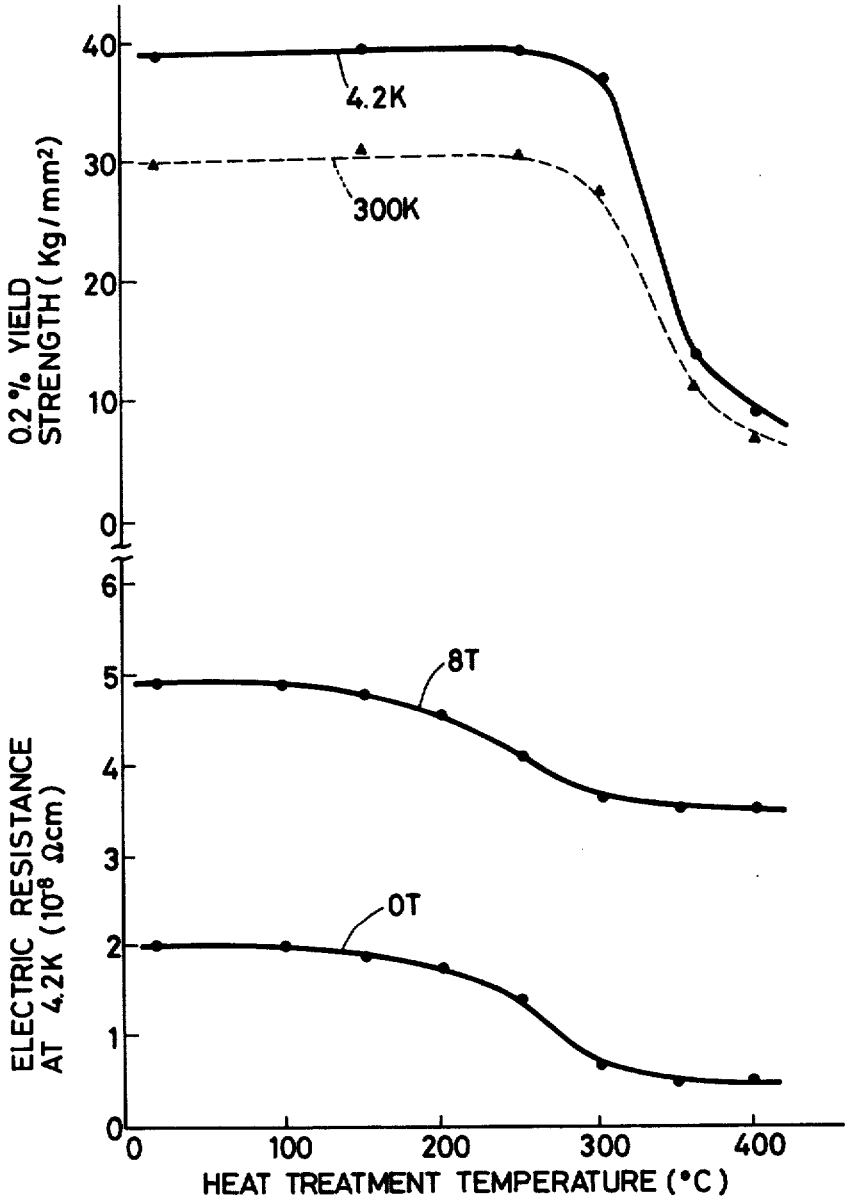
FIG. 3 is characteristic diagrams showing the relationships of a specific resistance and a 0.2% yield strength to the heat treatment temperature after the cold working process of the stabilizing material to be used in the superconducting coil of the present invention.

Secondly, the electric resistance of the stabilizing material can be remarkably reduced to a lower level without any substantial change in the conductor strength, as is shown in FIG. 3, than that at the state of only the cold-working process by subjecting the hardened oxygen-free copper to a heat treatment.

The softening temperature of the normally conductive metal such as the oxygen-free copper is dependent upon the material, purity, cold reduction ratio and so on of the normally conductive metal thereby to make it difficult to specify a certain value. Here, the softening temperature is defined to be a temperature at which recrystallization takes place to begin reduction in the mechanical strength. At a temperature lower than the softening point, therefore, the mechanical strength is hardly changed to be identical to that at the cold-worked state. On the other hand, the change in the electric resistance of the cold-worked normally conductive metal due to the heat treatment is caused by the shift of point defects so that it takes place at a temperature lower by 50° to 200° C. than the aforementioned softening point. As a result, a highly efficient intermetallic compound superconductor, which is sufficiently featured by the strength and the thermal stability of the intermetallic compound conductor, can be produced by hardening the stabilizing material as the normally conductive metal up to a necessary level for the conductor strength and by subjecting the stabilizing material to a heat treatment at a temperature lower by 50° to 200° C. than the softening temperature of the hardened normally conductive metal.

Thirdly, the intermetallic compound superconducting coil is made immovable during the magnetizing process of the coil by using either the hardened oxygen-free copper wires or the oxygen free copper wires, which have been subjected to the heat treatment after the hardening process, so that it can be prevented from having its performance deteriorated.

Figure 4:
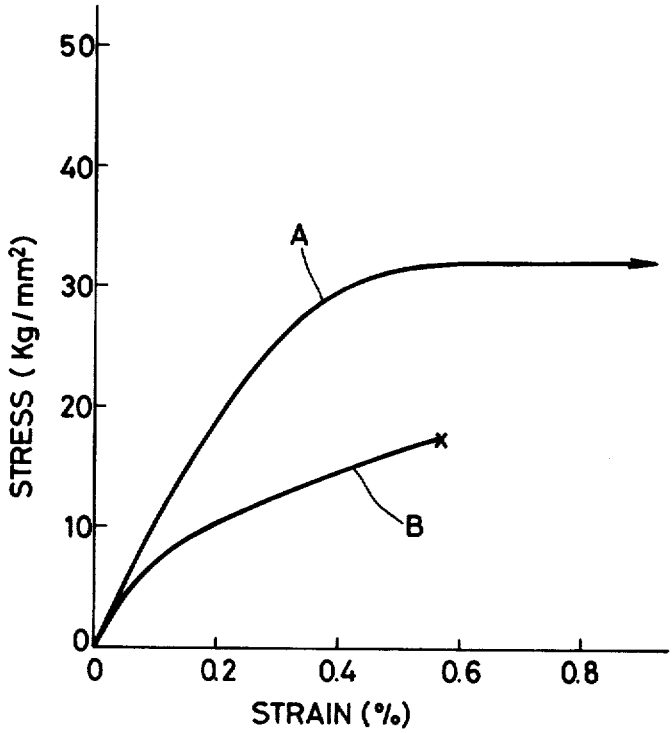
FIG. 4 is a stress-strain diagram of superconducting wires of $Nb_3Sn$ and oxygen-free copper wires at a room temperature.

In order to make the superconducting coil immovable during the magnetizing process, more specifically, it is necessary to firmly wind the wires with a tension stronger than the electromagnetic stress to be applied to the coil. Since such electromagnetic stress exceeds 10 $Kg/mm^2$ for the highly magnetic superconducting coil of medium or larger size, the intermetallic compound superconducting wires have to be wound with the tension stronger than 10 $Kg/mm^2$. However, as is seen from the stress-strain diagram of the superconducting wires of $Nb_3Sn$ as the intermetallic compound superconducting wires at a room temperature (i.e., 25° C.), as indicated by a characteristic curve B in FIG. 4, for example, if the winding operation is conducted with the tension of 10 $Kg/mm^2$, there is raised a danger that a strain of 0.1% is caused in the oxygen-free copper wires of cold reduction ratio of 25%, as indicated by a characteristic curve A in FIG. 4, whereas a strain higher than 0.2% is caused in the superconducting wires of $Nb_3Sn$ so that the performance of the superconducting coil as a whole is deteriorated as a result of addition of the bending strain during the winding operation. As shown in FIG. 2, however, the cold-worked oxygen-free copper wires have a high 0.2% yield strength and exhibits a far higher yield strength at a temperature of 4.2° K. than at a temperature of 300° K. Thus, the strength and the temperature stability of the superconducting coil can be improved, as has been described hereinbefore, by winding the cold-worked oxygen-free copper wires together with the intermetallic compound superconducting wires thereby to produce the coil. For example, by winding the cold-worked oxygen-free copper wires with a wiring tension of 15 to 20 Kg/mm$^2$, the intermetallic compound superconducting coil can be firmly wound even if the intermetallic compound superconducting wires are wound with a wiring tension of several Kg/mm$^2$. As a result, even if a strong electromagnetic stress is applied, the intermetallic compound superconducting coil can be prevented from any movement so that the superconducting magnet device can be stably operated.

Fourthly, by winding the oxygen-free copper wires and the intermetallic compound superconducting wires without being metallically bonded to each other thereby to produce the coil, there can be attained advantages that the oxygen-free copper wires and the intermetallic compound superconducting wires can be wound with different winding tensions, as has been described hereinbefore and that the bending strain upon the coil winding operation can be reduced the more than that in case the oxygen-free copper wires and the intermetallic compound superconducting wires are metallically bonded by means of a soft solder. That bending strain is the highest in various strains which are to be applied to the intermetallic compound superconducting coil. By adopting the method thus far described, the total strain can be lightened, and the intermetallic compound high magnetic field superconducting coil of medium size can be easily produced.

Incidentally, the cold reduction of the oxygen-free copper wires is preferred to fall within a range of the reduction ratio of 15 to 50%. As shown in FIG. 2, in the case of the reduction ratio equal to or lower than 15%, e.g., in the case of the reduction ratio near 0%, the 0.2% yield strength becomes lower than 10 Kg/mm$^2$. As a result, the electromagnetic stress (e.g., 10 Kg/mm$^2$) of the coil overcomes the 0.2% yield strength to invite a fear that it is impossible to expect the reinforcing effect of the hardened oxygen-free copper wires. For the reduction ratio exceeding 50%, on the other hand, the oxygen-free copper wires are excessively hardened so that their winding operation becomes difficult.

Specific embodiments of the present invention, which are constructed in accordance with the discoveries thus far described, will be described hereinafter together with examples.

The embodiments and the examples were compared and examined by producing coils of the same shape with $Nb_3Sn$ superconducting wires having a width of 4.3 mm and a thickness of 1 mm in the case where they were wound together with the hardened oxygen-free copper wires and in case where no oxygen-free copper wire was used.

Embodiment

One embodiment of the present invention will be described in the following with reference to FIG. 1.

The coil was sized to have an internal diameter of 150 mm, an external diameter of 500 mm and a height of 300 mm. The oxygen free copper wires 22 having a cold reduction ratio of 25%, a width of 4.3 mm and a thickness of 1 mm were wound flatwise, while an insulating tape having a thickness of 0.4 mm being applied to their flat surfaces, to produce the coil 1. Insulating spacers having a thickness of 2 mm were inserted between the adjacent turns of the coil 1 to provide the cooling channels 4. Moreover, the coil thus produced was firmly wound by applying a tension of 15 Kg/mm$^2$ to the oxygen-free copper wires 22 and a tension of 5 Kg/mm$^2$ to the $Nb_3Sn$ superconducting wires 21.

EXAMPLE FOR COMPARISON

Another coil not to be wound together with the oxygen-free copper wires was produced by winding the $Nb_3Sn$ superconducting wires having the same sizes as the aforementioned ones with a tension of 5 Kg/mm$^2$, and insulating spacers having a thickness of 2 mm were inserted into the adjacent turns of the coil to provide the cooling channels.

Both the coils thus produced according to the embodiment and the comparison were dipped in liquid helium at a temperature of 4.2° K. and were subjected to separate magnetizing tests. As a result, the intermetallic compound superconducting coil wound with the oxygen-free copper wires could exhibit the short characteristics of the intermetallic compound superconducting wires at a first magnetization, i.e., generate such a magnetic field of 10 teslas as was substantially coincident with a critical current.

Figure 5:
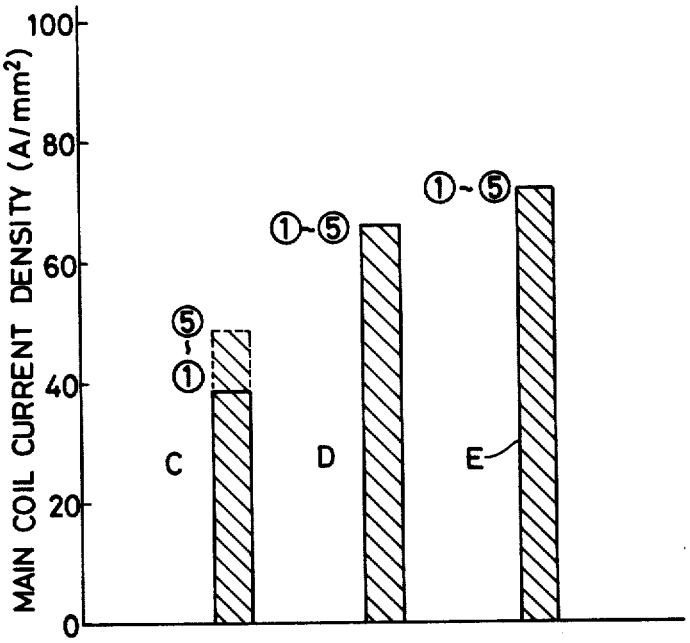
FIG. 5 is a graph for comparing the mean densities of coil currents which can be fed to the superconducting coils according to the prior art and the present invention.

The mean coil current density of the coil as a whole at this time was 66.1 A/mm$^2$ independently of the number of magnetizing times, as indicated by letter D in FIG. 5. Incidentally, circled numerals appearing in FIG. 5 indicate the number of the magnetizations.

Letter E appearing in FIG. 5 shows the case in which the coil was produced by winding the oxygen-free copper wires 22 having been subjected to a heat treatment for one hour at 250° C. after the cold reduction of 25% and the $Nb_3Sn$ superconducting wires 21 while applying a tension of 15 Kg/mm$^2$ to the former and a tension of 5 Kg/mm$^2$ to the latter. In this case, too, the coil exhibited the short characteristics coincident with the short characteristics of the intermetallic compound superconducting wires by an initial magnetization and generated a magnetic field of 10 teslas. The mean coil current density of the coil as a whole at this time was 72 A/mm$^2$ independently of the number of the magnetizations, as shown by letter E in FIG. 5.

Next, the results of the tests of another intermetallic compound superconducting coil which was not wound with the oxygen-free copper wires have revealed that the coil was quenched at 5.8 teslas by the magnetization of the first time so that it could not generate a central magnetic field higher than 7.3 teslas although the performance was improved to some extent thanks to the training effect after the magnetizations were repeated five times. Incidentally, the mean coil current density of the coil as a whole at that time was 48.3 A/mm$^2$. This is deduced to come from the fact that the intermetallic compound superconducting coil using none of the hardened oxygen-free copper wires has their short wire performances degraded by the strain during the repetitions of the trainings as a result that its intermetallic compound superconducting wires were moved by the magnetic stress of about 10 Kg/mm$^2$.

Although, in the foregoing embodiment, the description has been made by taking the $Nb_3Sb$ superconducting wires by way of an example, the influence of the strain is similar for the $V_3Ga$ or other intermetallic compound superconducting wires, and similar effects can be expected by applying the present invention. Moreover, it is apparent that the present invention itself can be applied even if the shape of the intermetallic compound superconducting wires or the construction of the coil is changed.

According to the present embodiment thus far described, the intermetallic compound superconducting coil, which might otherwise be liable to have its performance deteriorated for a strain, can be more easily and stably as the coil, which is reluctant to be deteriorated even by a strong electromagnetic force applied, than the prior art example. Especially this effect is the more prominent for the larger size and the higher magnetic field of the intermetallic compound superconducting coil. On the other hand, the superconducting coil of medium size is required to have an expecially high current density. According to the present invention, the mean current density of the 40 to 70% coil can be enhanced the more than the intermetallic compound superconducting coil of the prior art can be enhanced to enjoy remarkably high economic effects partly because the performance is not deteriorated for the strain, partly because the superconducting wires are not moved by the electromagnetic force, and partly because the oxygen-free copper wires having an excellent thermal conductivity are wound together with the intermetallic compound superconducting wires.

As has been described hereinbefore, according to the present invention, since the oxygen-free copper wires for the single metal are used as a reinforcing member, it is possible to provide an intermetallic compound superconducting coil which is strong and stable and which can minimize the strain to be generated when a strong electromagnetic force is generated.

What is claimed is:

1. A superconducting magnet device which comprises a coil of intermetalllic compound superconducting wires wound upon a core of said device in parallel and in multiple layers together with wires of a stabilizing material for thermally stabilizing said superconducting wires, said wires of the stabilizing material being oxygen-free copper wires which are hardened by a cold working process before being wound upon said coil core.

2. A superconducting magnet device according to claim 1, wherein said oxygen-free copper wires are subjected to the cold working process with a cold reduction ratio equal to or higher than 15%.

3. A superconducting magnet device according to claim 1, wherein said oxygen-free copper wires are wound by a winding tension stronger than that to be applied to said intermetallic compound superconducting wires.

4. A superconducting magnet device according to claim 1, wherein said oxygen-free copper wires are wound without being metallically bonded to said intermetallic compound superconducting wires.

5. A superconducting magnet device according to claim 1, wherein said oxygen-free copper wires are subjected to a heat treatment at a temperature equal to or lower than the softening temperature of oxygen-free copper after the cold working process.

6. A superconducting magnet device according to claim 2, wherein said oxygen-free copper wires are subjected to the cold working process with a cold reduction ratio equal to or lower than 50%.

7. A superconducting magnet device according to claim 1, wherein said oxygen-free copper wires are subjecting to the cold working process with a cold reduction ratio equal to 15 to 50%.

8. A superconducting magnet device according to claim 7, wherein said oxygen-free copper wires are wound by a winding tension of 15 to 20 kg/mm$^2$, which is stronger than that applied to said intermetallic compound superconducting wires.

9. A superconducting magnet device according to claim 8, wherein said oxygen-free copper wires are wound without being metallically bonded to said intermetallic compound superconducting wires.

10. A super conducting magnet device according to claim 9, wherein said oxygen-free copper wires are subjected to a heat treatment at a temperature lower by 50° to 200° C. than the softening temperature of the oxygen-free copper wires after the cold working process.

* * * * *